US005162814A

United States Patent [19]

Shirakawa et al.

[11] Patent Number: 5,162,814

[45] Date of Patent: Nov. 10, 1992

[54] RESIN-COATED THERMAL PRINTER HEAD

[75] Inventors: Takashi Shirakawa; Toshifumi Nakatani, both of Takizawa, Japan

[73] Assignee: Alps Electric Co., Ltd., Tokyo, Japan

[21] Appl. No.: 682,488

[22] Filed: Apr. 9, 1991

[30] Foreign Application Priority Data

May 24, 1990 [JP] Japan ..... 2-134291

[51] Int. Cl.[5] ..... B41J 2/335

[52] U.S. Cl. ..... 346/76 PH

[58] Field of Search ..... 346/76 PH; 219/543

[56] References Cited

U.S. PATENT DOCUMENTS 4,907,015 5/1990 Kaneko et al. ..... 346/76 PH
4,990,939 2/1991 Sekiya et al. ..... 346/140 R

FOREIGN PATENT DOCUMENTS 0025972 2/1983 Japan .
0029172 2/1984 Japan .
0195365 11/1984 Japan .
0158475 7/1986 Japan ..... 346/76 PH
2095244 5/1987 Japan ..... 346/76 PH
0197664 8/1988 Japan .

*Primary Examiner*—Benjamin R. Fuller
*Assistant Examiner*—N. Le
*Attorney, Agent, or Firm*—Guy W. Shoup; David W. Heid

[57] ABSTRACT

A thermal head for use in a printer or a facsimile machine and a method for manufacturing the same are disclosed. The thermal head having a heat regenerative layer, heating elements and electrodes respectively formed on the substrate thereof and in which they are covered with a protection layer is manufactured by forming a coating made of a thermosetting resin on the protection layer. Thus, pin holes formed in the protection layer due to the roughness of the surface of the substrate can be sealed up so that the reliability of the thermal head is improved.

12 Claims, 1 Drawing Sheet

RESIN-COATED THERMAL PRINTER HEAD

SUMMARY OF THE INVENTION

1. Field of the Invention

The present invention relates to a thermal head for use in a printer for a computer or a word processor or a facsimile machine and a method of manufacturing the same. More particularly, the present invention relates to a thermal head using cheap electrode material and capable of producing good printed characters and a method of manufacturing the same.

2. Related Art

A conventional thermal head of the type described above will now be described with reference to FIG. 2. In order to improve thermal responsibility, the thermal head shown in FIG. 2 is arranged to have a glazed layer serving as a heat regenerative layer and partially formed on the surface of an insulating substrate thereof.

Referring to FIG. 2, the thermal head comprises an insulating substrate 1 made of alumina and a glazed layer 2 made of glass and serving as a heat regenerative layer. The glazed layer 2 is formed in the vicinity of a portion of the insulating substrate 1 in which heating elements are formed in such a manner that the glazed layer 2 covers a portion of the surface of the insulating substrate 1. The glazed layer 2 has a top surface thereof the cross sectional shape of which is in the form of a circular arc. The glazed layer 2 has, on the surface thereof, a plurality of heating resistors 3 made of $Ta_2N$, $Ta\text{-}SiO_2$ or the like and disposed in series at predetermined intervals, the number of the heating resistors 3 being arranged to correspond to the number of heating dots. A pair of electrodes 4 made of Al or Cu are respectively connected to the two ends of each of the heating resistors 3. One of the pair of the electrodes 4 is arranged to serve as an independent electrode 4*a* which independently passes an electric current, while the other electrode 4 is arranged to serve as a common electrode 4*b* which commonly passes an electric current toward the heating resistors 3. The heating resistors 3 disposed more adjacent to the central portion of the thermal head than the position at which each of the electrodes 4 is connected are arranged to serve as heating elements 3A which are heated by the supplied electricity so as to contribute to the actual printing operation. Furthermore, the surface of each of the above-described insulating substrate 1, the glazed layer 2, the heating resistors 3 and the electrodes 4 is covered with a protection layer 5 made of $Si_3N_4$ or the like for the purpose of improving oxidation resistance and wear resistance.

According to the thermal head thus constituted, an electric current is supplied through the independent electrode 4*a* to the common electrode 4*b* via the corresponding heating resistor 3 in response to a predetermined print signal. In consequence, in a thermal transfer printer, the heating element 3A of the heating resistor 3 generates heat which melts up ink of an ink ribbon positioned in contact with the protection layer 5 disposed on the heating element 3*a*, the melted ink being then transferred to a printer sheet. On the other hand, the heat thus generated causes a thermosensitive paper to emit colors in a case of a thermal printer. As a result, desired printed characters can be obtained on the surface of a printing sheet.

In the conventional thermal head having the above-described glazed layer 2 formed in part thereof, the insulating substrate 1 made of alumina is exposed to the outside except for the portion covered with the glazed layer 2. However, since the insulating substrate 1 made of alumina has a rough surface, a multiplicity of pin holes P will be undesirably formed in the protection layer 5 when the protection layer 5 is formed by sputtering or the like. Furthermore, the electrode 4 on the smooth surface of the glazed layer 2 has an excessively large thickness of about 2 μm. In consequence, the step portion of the protection layer 5 at the end of each of the electrodes 4 cannot satisfactorily be covered. As a result, pin holes P can easily be formed in the protection layer 5 formed above the glazed layer 2.

When a thermal head which employs Al or Cu which is a cheap material for the electrode 4 is subjected to a corrosion resistance test in which the thermal head is held in a wet atmosphere including chloride, the electrode 4 of the thermal head can easily be corroded by water or chloride ions introduced through the pin holes P formed in the protection layer 5. In consequence, a disconnection will occur, and what is even worse, the resistance will be enlarged excessively.

Accordingly, in order to improve the corrosion resistance of the electrode 4, a disclosure has been made in which an insulating thermal plastic resin such as photoresist is applied to the surface of the insulating substrate made of alumina. Another disclosure has been made in which baking is performed after an $SiO_2$ solution has been applied as described above. However, a practical structure has not been realized since the above-described disclosures suffer from the following problems:

The insulating thermal plastic resin has insufficient chemical resistance against resist separation liquid, cleaning liquid such as organic solvents, acids, alkalic solutions and plating liquid. In particular, a major portion of the thermal plastic resins cannot be suitably used when the external connecting terminals of the thermal head are subjected to soldering or plating.

The $SiO_2$ solution also encounters a problem since it is a porous material in that cracks will easily be generated in the $SiO_2$ film due to applied heat if the formed film has a large thickness. As a result, the $SiO_2$ solution cannot be used at a prebaking temperature of 100° to 150° C. or higher. Furthermore, the cost of the material cannot be reduced.

Therefore, either of the above-described materials cannot satisfactorily seal up the pin holes formed in the protection layer 5.

SUMMARY OF THE INVENTION

Accordingly, an object of the present invention is to provide a thermal head which reveals excellent reliability and capable of printing characters of good quality even if a corrosive and cheap power supplying material such as Al, Cu or the like is used, and a method of manufacturing the same.

Another object of the present invention is to provide a thermal head having a heat regenerative layer formed on a substrate thereof, a plurality of heating elements formed on the heat regenerative layer, electrodes for respectively supplying electric currents to the heating elements and connected to the heating elements and a protection layer covering the heat regenerative layer, the heating elements and the electrodes, the thermal head comprising: a thermosetting resin coating formed on the protection layer.

A further object of the present invention is to provide a thermal head arranged in such a manner that each of the heating elements has a portion contributing to heating and arranged to project over the other portions.

A still further object of the present invention is to provide a method of manufacturing a thermal head having a heat regenerative layer formed on a substrate thereof, a plurality of heating elements formed on the heat regenerative layer, electrodes for respectively supplying electric currents to the heating elements and connected to the heating elements and a protection layer covering the heat regenerative layer, the heating elements and the electrodes, the method of manufacturing a thermal head comprising steps of: applying thermosetting resin solution to the surface of the protection layer; and forming a thermosetting resin coating by heating or applying ultraviolet rays to the thermosetting resin solution.

According to the method of manufacturing a thermal head according to the present invention, an external connection terminal portion of each of the electrodes may be subjected to plating after the thermosetting resin coating has been formed on the protection layer.

According to the thus constituted thermal head and a method of manufacturing the same, pin holes formed in the protection layer can be sealed up by covering the surface of the protection layer with the thermosetting resin. The thus formed thermosetting resin can easily be removed due to an abrasion with the thermosensitive paper or the ink ribbon at the time of a trial printing operation. Therefore, deterioration in the quality of printed characters due to the insufficient heat conductivity caused from the presence of the above-described thermosetting resin can be prevented at the time of the actual printing operation. The thermosetting resin can further easily be removed by the abrasion by arranging the structure in such a manner that the portion of each of the heating elements which contribute to heating is projected over the other portions.

In addition, since the terminal of each of the electrodes is subjected to plating after the thermosetting resin coating has been formed on the protection layer, corrosion of the electrodes caused by the plating solution introduced into the pin holes formed in the protection layer can be prevented.

Other and further objects, features and advantages of the invention will be appear more fully from the following description.

DESCRIPTION OF THE PREFERRED EMBODIMENTS

Figure 1:
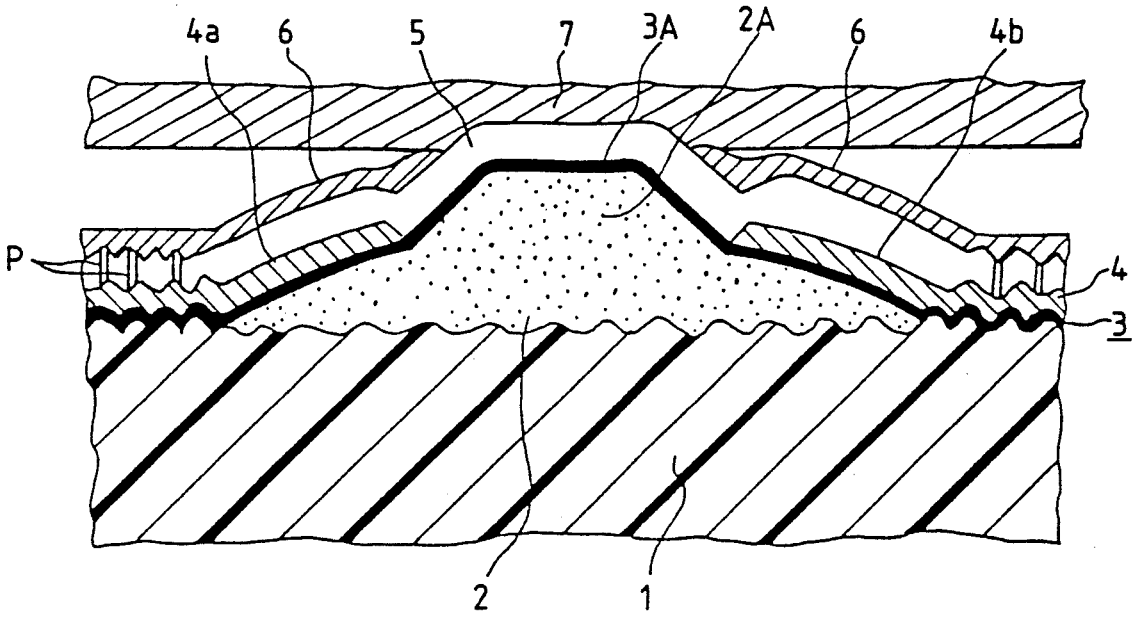
FIG. 1 is a vertical cross sectional view which illustrates an embodiment of a thermal head according to the present invention.
Figure 2:
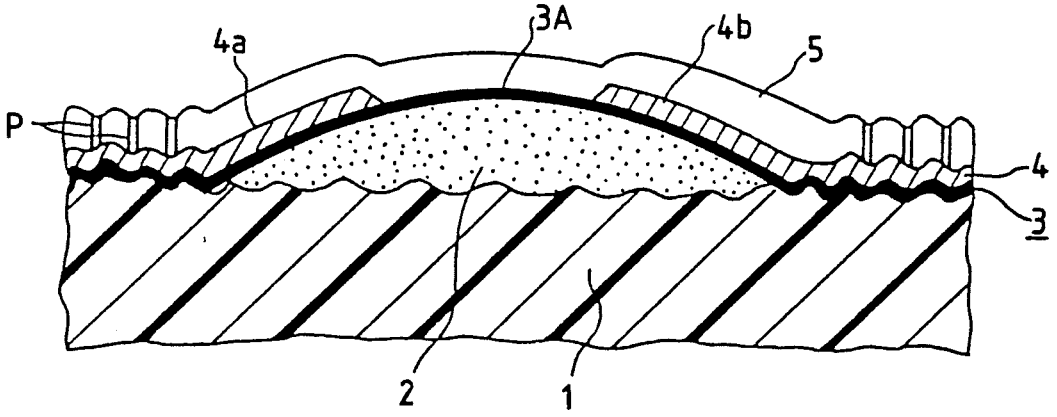
FIG. 2 PRIOR ART
FIG. 2 is a vertical cross sectional view which illustrates a conventional thermal head.

A preferred embodiment of the present invention will now be described with reference to the drawings, where the same elements as those according to the above-described conventional thermal head are given the same reference numerals.

FIG. 1 is a cross sectional view which illustrates an essential portion of an embodiment of a thermal head according to the present invention.

Referring to FIG. 1, the thermal head comprises an insulating substrate 1 made of alumina and a glazed layer 2 made of glass and serving as a heat regenerative layer. The glazed layer 2 is formed in the vicinity of a portion of the insulating substrate 1 in which heating elements are formed in such a manner that the glazed layer 2 covers a portion of the surface of the insulating substrate 1. The glazed layer 2 has a top surface thereof the cross sectional shape of which is in the form of a substantially circular arc. The glazed layer 2 has, on the surface thereof, a plurality of heating resistors 3 made of $Ta_2N$, $Ta\text{-}SiO_2$ or the like and disposed in series at predetermined intervals, the number of the heating resistors 3 being arranged to correspond to the number of heating dots. A pair of electrodes 4 made of Al or Cu are respectively connected to the two ends of each of the heating resistors 3. One of the pair of the electrodes 4 is arranged to serve as an independent electrode **4*a* which independently passes an electric current, while the other electrode 4 is arranged to serve as a common electrode 4*b* which commonly passes an electric current toward the heating resistors 3. The heating resistors 3 disposed more adjacent to the central portion of the thermal head than the position at which each of the electrodes 4 is connected are arranged to serve as heating elements 3A which are heated by the supplied electricity so as to contribute to the actual printing operation. Furthermore, the surface of each of the above-described insulating substrate 1, the glazed layer 2, the heating resistors 3 and the electrodes 4 is covered with a protection layer 5** made of $Si_3N_4$ or the like for the purpose of improving oxidation resistance and wear resistance.

According to this embodiment, a projection 2A is integrally formed with the top end of the glazed layer 2 at the central portion in the widthwise direction of the glazed layer 2, the projection 2A being made of glass and upward projecting to form a substantially isosceles trapezoid cross section. In consequence, the portion of the protection layer 5 placed above the heating element 3A of each of the heating resistors 3, which actually contributes to the printing operation, is strongly brought into contact with a recording medium such as an ink ribbon or thermosensitive paper. Therefore, the heating element 3A of each of the heating resistors 3 positioned on the projection 2A of the glazed layer 2 is considerably projected upward.

The substantially entire surface of the protection layer 5 is coated with a thermosetting resin coating 6. As the thermosetting resin coating 6, any of the following resins may be employed: one fluid type resin such as silicon resin, phenol resin, melamine resin, alkyd resin and acryl resin and two fluid type resin such as polyurethane resin and epoxy resin.

The thermosetting resin coating 6 can be formed on the protection layer 5 in such a manner that the thermosetting resin solution is roll-coated, spin-coated, spray-coated or printed to the surface of the protection layer 5 so as to form a coating film. Furthermore, the thus formed coating film is heated or applied with ultraviolet rays so as to harden the coating film so that the thermosetting resin coating 6 revealing good chemical resistance is formed.

When the thermosetting resin coating 6 is being formed, an external connection terminal (omitted from illustration) of each of the electrodes 4 must be protected during the time in which the resin is hardened by heat or ultraviolet rays applied thereto after the thermosetting resin solution has been applied to the protection layer 5.

If a heat resistant tape made of polyimide is used as the masking to be applied for the purpose of protecting the external connection terminal, the thermosetting resin solution can be applied by any one of roll coating, spin coating, spray coating, print coating or the like after the protection layer 5 has been formed. The heat resistant masking tape may be separated after the thermosetting resin has been hardened by heat or ultraviolet rays applied thereto and the thermosetting resin coating 6 has been formed.

In a case where a metal mask made of a metal plate or the like is used, the thermosetting resin solution may be applied to the substantially entire surface of the protection layer 5 except for the external connection terminal by the printing method so as to be similarly hardened.

According to the above-described structure, the thermal head according to this embodiment is manufactured in such a manner that the projection 2A is integrally formed with the glazed layer 2. Furthermore, the heating element 3A of each of the heating resistors 3 is formed on the flat top end portion of the projection 2A. Therefore, the thermosetting resin coating 6 formed on the protection layer 5 which covers each of the heating elements 3A is forcibly brought into contact with a recording medium 7 such as an ink ribbon or thermosensitive paper due to the printing action of the thermal head. Furthermore, since the thermosetting resin coating 6 is repeatedly subjected to heat and friction with the recording medium, it can be easily separated and removed. Therefore, a state, in which printed characters revealing a good quality can be obtained, is able to easily be realized. This means a fact that the thermosetting resin coating 6 formed above each of the heating elements 3A is removed during the printing test carried out at a manufacturing plant before the delivery of the products. In consequence, undesired influences of the presence of the thermosetting resin coating 6 can be prevented at the time of the actual printing operation by a user.

According to this embodiment, pin holes P formed in the protection layer 5 can be immediately sealed up by the thermosetting resin coating 6 after the protection layer 5 has been formed. Therefore, the corrosion resistance of the electrode 4 can be significantly improved since the activity of the surface of the electrode 4 can be deteriorated since a plating solution is introduced into the pin hole P formed in the protection layer 5 at the time of soldering or plating the external connection terminal. Furthermore, the presence of the thermosetting resin coating 6 prevents the adhesion of the plating particles to the surface of the protection layer 5. Therefore, a problem of a short circuit can be completely overcome even if the electrode 4 is subjected to high density wiring. It is preferable to employ silicon resin as the thermosetting resin for forming the thermosetting resin coating because it reveals a satisfactorily total balance in its characteristics. Furthermore, a variety of silicon resins can be available and a type having a desired viscosity can be selected. In addition, the thermosetting resin coating 6 made of silicon resin exhibits excellent water repellency heat resistance, release characteristics, moisture resistance and plating solution resistance. Furthermore, paper dust cannot easily adhere to the portion adjacent to the heating element 3A in a case where characters are printed to thermal sensitive paper. In addition, the resin film formed on the projection 2A of the glazed layer 2 can be selectively partially removed. Consequently, the corrosion resistance of the power supply layer can significantly be improved while maintaining good quality of printed characters.

The present invention is not limited to the above-described embodiment. A variety of methods of manufacturing the thermal head, the ranges of the film thickness and manufacturing conditions may be employed. Furthermore, the present invention may be applied to any of the line thermal head or the serial thermal head.

As described above, with the thermal head and a method of manufacturing the same according to the present invention, a thermal head exhibiting an excellent reliability can be manufactured even if a cheap and corrosive material is used. Furthermore, characters revealing good quality can always be printed when the characters are printed by using that thermal head.

Although the invention has been described in its preferred form with a certain degree of particularity, it is understood that the present disclosure of the preferred form may be changed in the details of construction and the combination and arrangement of parts without departing from the spirit and the scope of the invention as hereinafter claimed.

What is claimed is:

1. A thermal head comprising:

a heat regenerative layer formed on a substrate;

a plurality of heating elements formed on said heat regenerative layer;

electrodes connected to each of said heating elements for respectively electrically energizing each of said heating elements;

a protection layer covering said heat regenerative layer, said heating elements and said electrodes such that a portion of said protection layer separates said electrodes; and a thermosetting resin coating formed on said protection layer such that said resin coating overlays each region of said protection layer that interfaces with one of said electrodes.

2. A thermal head according to claim 1, wherein a portion of said protection layer in a recording medium contacting region of said thermal head is raised above other portions of said protection layer.

3. A thermal head according to claim 2, wherein said thermosetting resin coating is not formed on said raised portion of said protection layer such that said raised portion of said protection layer contacts said recording medium during use of said thermal head.

4. A thermal head according to claim 2, wherein a top of said raised portion of said protection layer is flat.

5. A thermal head according to claim 2, wherein said raised portion of said protection layer is convex.

6. A thermal head according to claim 1, wherein resin for forming said thermosetting resin coating is selected from a group consisting of silicon resin, phenol resin, melamine resin, alkyd resin, acryl resin, polyurethane resin and epoxy resin.

7. A thermal head comprising:

a heat regenerative layer formed on a substrate;

a plurality of heating elements formed on said heat regenerative layer;

electrodes connected to each of said heating elements for respectively electrically energizing each of said heating elements;

a protection layer covering said heat regenerative layer, said heating elements and said electrodes, a portion of said protection layer in a recording medium or printer ribbon contacting region of said thermal head raised above other portions of said protection layer; and a thermosetting resin coating formed on said protection layer, overlaying portions of said protection layer which interfaces with said electrodes.

8. A thermal head according to claim 7, wherein said thermosetting resin coating is not formed on said raised portion of said protection layer such that said raised portion of said protection layer contacts said recording medium or printer ribbon during use of said thermal head.

9. A thermal head according to claim 7, wherein resin for forming said thermosetting resin coating is selected from a group consisting of silicon resin, phenol resin, melamine resin, alkyd resin, acryl resin, polyurethane resin and epoxy resin.

10. A thermal head according to claim 7, wherein a cross-sectional shape of said raised portion of said protection layer is a trapezoid.

11. A thermal head according to claim 7, wherein a top of said raised portion of said protection layer is flat.

12. A thermal head according to claim 7, wherein said raised portion of said protection layer is convex.

* * * * *